US005819962A

United States Patent [19]

Okubo et al.

[11] Patent Number: 5,819,962

[45] Date of Patent: Oct. 13, 1998

[54] APPARATUS FOR STOPPING THE OSCILLATION OF HOISTED CARGO

[75] Inventors: Yoshiaki Okubo; Koichi Inoue, both of Hiroshima, Japan

[73] Assignee: Mitsubishi Jukogyo Kabushiki Kaisha, Tokyo, Japan

[21] Appl. No.: 705,008

[22] Filed: Aug. 29, 1996

Related U.S. Application Data

[63] Continuation of Ser. No. 331,522, filed as PCT/JP94/00353, Mar. 4, 1994, abandoned.

[30] Foreign Application Priority Data

Mar. 5, 1993 [JP] Japan ..... 5-044928

[51] Int. Cl.[6] ..... B66C 13/08

[52] U.S. Cl. ..... 212/275; 294/81.4

[58] Field of Search ..... 212/274, 275, 212/315, 318; 294/81.3, 81.4

[56] References Cited

U.S. PATENT DOCUMENTS

| | | | |
|---|---|---|---|
| 3,653,518 | 4/1972 | Polen | 212/274 |
| 3,825,128 | 7/1974 | Cooper | 212/274 |
| 3,837,503 | 9/1974 | Komatsu | 212/274 |
| 4,531,647 | 7/1985 | Higuchi et al. | 212/274 |
| 4,687,110 | 8/1987 | Partanen et al. | 212/274 |
| 5,018,631 | 5/1991 | Reimer | 212/274 |

FOREIGN PATENT DOCUMENTS

| | | | |
|---|---|---|---|
| 467783 | 1/1992 | European Pat. Off. | 212/275 |
| 53-145257 | 12/1978 | Japan | B66C 13/08 |
| 1-83785 | 1/1989 | Japan | B66C 13/22 |

*Primary Examiner*—Thomas J. Brahan
*Attorney, Agent, or Firm*—Fish & Richardson P.C.

[57] ABSTRACT

An apparatus for stopping the transverse swing and skew motions of a hoisted cargo according to the present invention comprises a pair of movable frames (15) which are disposed on a transversely moving trolley (1) along left and right sides of the trolley (1) and which are movable with respect to the trolley (1) in a direction of movement of the trolley, two sets of guide sheaves (13, 14) for hoisting ropes fixedly arranged on each of said pair of movable frames (15) with a certain distance between the sets, and a pair of drive means (17) disposed on said trolley (1) for moving said pair of moving frames (15) independently with respect to said trolley (15), wherein the swing or skew motion, or a combination of these motions, of the cargo hoisted by the trolley (1) is reduced by the operation of the movable frames (15) (guide sheaves) disposed the opposite sides of the trolley (1). The apparatus can be made simpler, the control becomes easier and the arrangement of the apparatus enjoys a larger degree of freedom.

4 Claims, 4 Drawing Sheets

APPARATUS FOR STOPPING THE OSCILLATION OF HOISTED CARGO

This is a continuation of application Ser. No. 08/331,522 filed on Nov. 3, 1994, now abandoned, which is a 371 of International Application PCT/JP94/00353 filed on Mar. 4, 1994 and which designated the U.S.

TECHNICAL FIELD

The present invention relates to an apparatus for reducing oscillations of hoisted cargo that is particularly applicable to a container crane for a large size cargo.

BACKGROUND ART

A conventional apparatus for stopping oscillations of hoisted cargo which is used in a container crane is shown in FIG. 8. The conventional swing stopping apparatus comprises a transversely movable trolley 1 movable on a main girder (not shown) of the crane in the right and left directions facing FIG. 8 and four sets of guide sheaves 2. The guide sheaves 2 are provided on movable frames 3*a* and 3*b*, respectively. The movable frames 3*a* and 3*b* are provided on the transversely movable trolley 1 and transversely moved by drive means 4 for opening and closing the space between the movable frames 3*a* and 3*b*. When there occurs the transverse swing of a hoisting accessory, the frames 3*a* and 3*b* are moved toward and away from each other through ropes 5*a* and 5*b* by the drive means in order to stop the transverse swing.

A container 9 is supported by a hoisting plate 6 hoisted and supported by hoisting ropes 7*a* and 7*b* through sheaves 8 mounted on the plate 6 and the guide sheaves 2. A mark 10 is drawn on the hoisting plate for detection of swing by the eye.

The hoisting ropes 7*a* and 7*b* are hoisted by a hoisting drum 11 disposed on the crane. A skew stopping unit for stopping the skew (swivel swing in a horizontal plane) of a hoisted cargo is denoted by reference numeral 12 and comprises reciprocating cylinders provided in the intermediate portions of the hoisting ropes 7*a* and 7*b*.

When the container 9 is hoisted by the hoisting plate 6 and the trolley 1 is transversely moved, for example, from a land side to a sea side, the hoisting plate 6 is swung in the direction of movement because of acceleration and deceleration of the trolley 1. If there occurs a swing of the hoisting plate 6, the space between the movable frames 3*a* and 3*b* is opened with manipulation of the drive means 4 by a crane operator monitoring the swing visual-detection mark 10 drawn on the hoisting plate 6. As a consequence, the swing of the hoisting plate 6 is attenuated.

If there occurs a skew (swivel swing in a horizontal plane) of the hoisting plate 6, the hoisting ropes of the sheaves 8 on the rear side of the skew motion are pulled and the hoisting ropes of the sheaves 8 on the front side of the skew motion are loosed with the skew stopping unit 12, so that the skew of the hoisting plate 6 is stopped.

Since in the conventional apparatus the drive means 4 and the skew stopping unit 12 are operated separately, the transverse swing and skew of the hoisting plate 6 (and hoisted cargo) can be stopped individually. However, if the transverse swing and the skew occur at the same time, manipulations for stopping skew motion often do not synchronize with manipulations for stopping transverse motion, and therefore the transverse swing and the skew cannot be prevented effectively in such cases.

It is an object of the present invention to simplify the apparatus for stopping transverse skew and swing and provide an apparatus for stopping the transverse swing and skew of hoisted cargo which is capable of concurrently stopping the transverse swing and the skew with reliability.

SUMMARY OF THE INVENTION

Thus, the present invention provides an apparatus for stopping the oscillation of hoisted cargo which comprises a pair of movable frames which are disposed on a transversely movable trolley along left and right sides of the trolley and which are movable with respect to the trolley in a direction of movement of the trolley, two sets of guide sheaves for hoisting ropes fixedly arranged within each of said pair of movable frames with a certain distance between the sets, and a pair of drive means disposed on said trolley for moving said pair of moving frames independently with respect to said trolley.

Because the two sets of driving means operate to move the movable frames independently of the transversely moving trolley according to the present invention, the transverse swing of the hoisted cargo is stopped by moving the movable frames concurrently with the transverse swing of the hoisted cargo and wherein the skew of the hoisted cargo is stopped by moving the movable frames in opposite directions concurrently with the skew of the hoisted cargo. That is to say, a single apparatus can simultaneously attenuate the two motions of skew and swing. Therefore, even if skew and swing motions occur at the same time, a control quantity that reflects a sum of amplitudes of skew and swing motions is used to operate the two sets of driving mechanisms in the single apparatus for stopping oscillations, so as to easily and securely control two different oscillations at once and in combination. Accordingly, the apparatus according to the present invention is simple in structure and easy in control, and is capable of concurrently stopping the transverse swing and the skew with reliability.

PREFERRED MODE OF CARRYING OUT THE INVENTION

Figure 7:
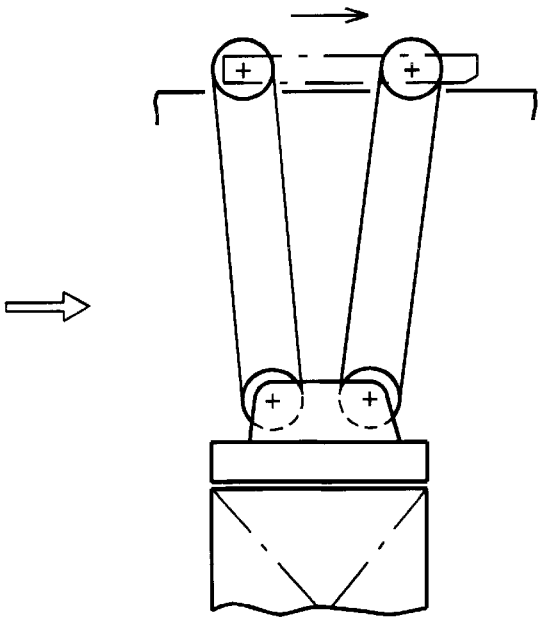
Figure 8:
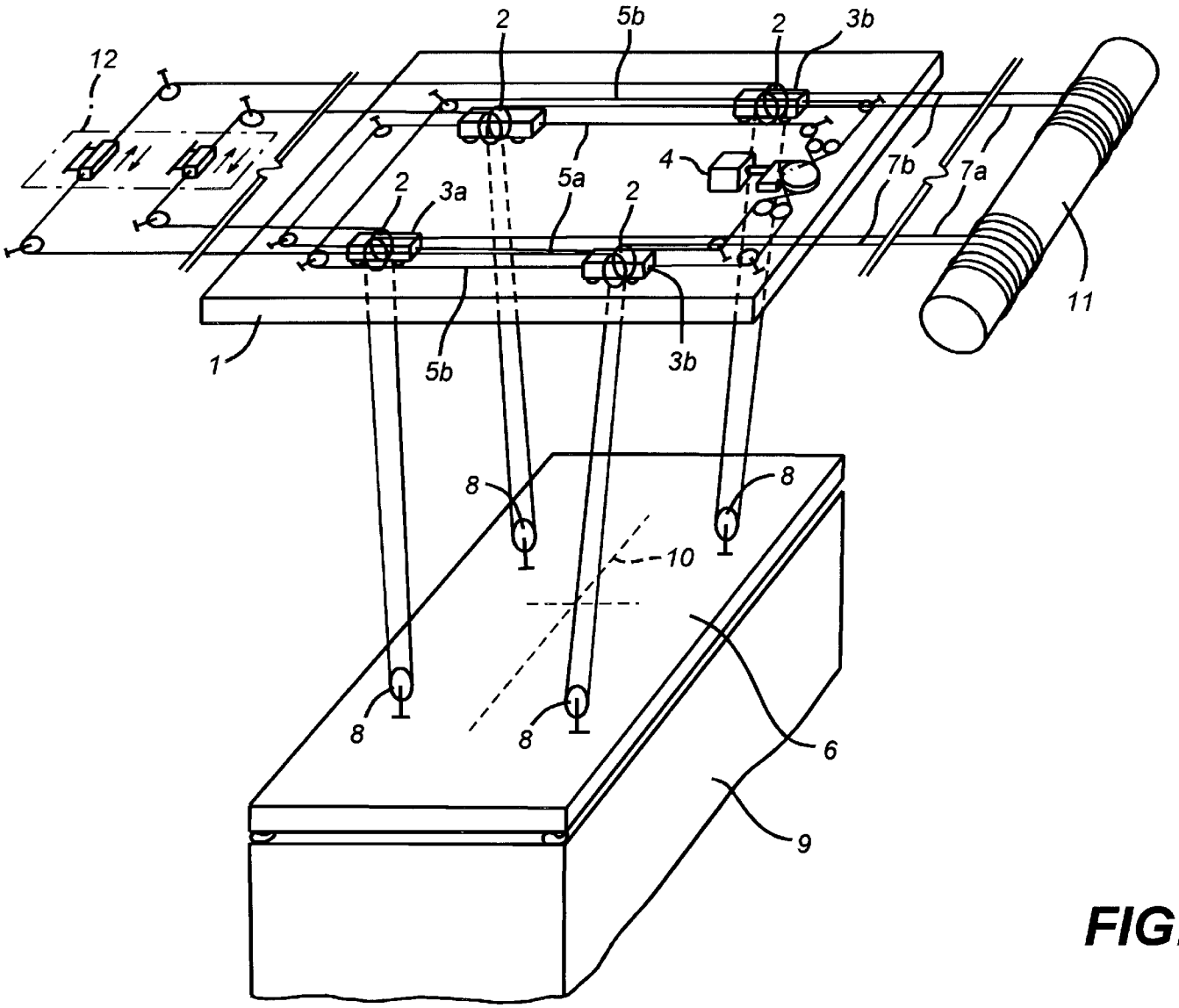
FIG. 8 is a schematic view illustrating a conventional apparatus for stopping oscillations of hoisted cargo.

Referring to FIGS. 1–7, there is shown a preferred embodiment of an apparatus for stopping oscillations of hoisted cargo in accordance with the present invention. Because the parts to which the same reference numerals as FIG. 8 are applied are identical to corresponding parts of FIG. 8, a detailed description of the identical parts will not be given.

Figure 1:
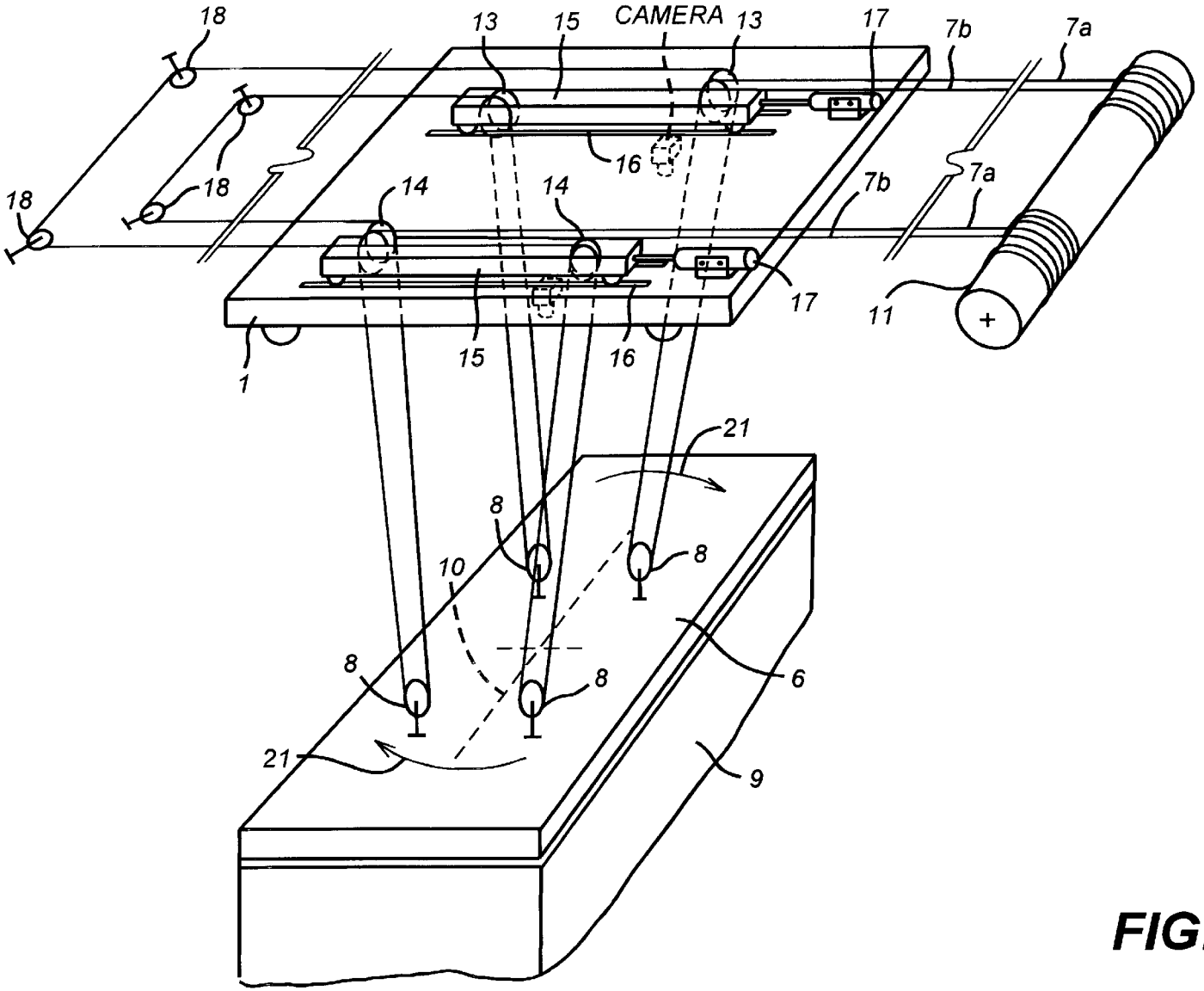
FIG. 1 is a schematic view illustrating an apparatus for stopping oscillations of hoisted cargo according to an embodiment of the present invention.

FIG. 1 shows an apparatus for stopping an oscillation of hoisted cargo which may be used in a container crane. In the figure, reference numerals 13 and 14 denote two pairs of guide sheaves respectively provided on the both sides of a transversely movable trolley 1. The guide sheaves 13, 13 and 14, 14 are fixedly supported by movable frames 15 and 15. The guide sheaves 13 and 13 are arranged with a predetermined spacing, and likewise the guide sheaves 14 and 14 are arranged with the predetermined spacing. The movable frames 15 and 15 are movable on and along rails 16 and 16, which are mounted on the both side ends of the transverse trolley 1. Reference numerals 17 and 17 denote drive means which are mounted on the transverse trolley 1 so that the movable frames 15 and 15 can be separately moved on the rails 16 and 16 with respect to the transverse trolley 1. An inner hoisting rope 7*a* extends from a hoisting drum 11 to the left guide sheave 13 and passes over a sheave 8 mounted on a hoisting plate 6 and returns back to the left guide sheave 13. The inner hoisting rope 7*a* further passes over inner equalizer sheaves 18 and 18, the left guide sheave 14 and a sheave 8 mounted on the hoisting plate 6, and returns back to the hoisting drum 11 through the left guide sheave 14. Likewise, an outer hoisting rope 7*b* extends from the hoisting drum 11 to the right guide sheave 13 and passes over a sheave 8 mounted on the hoisting plate 6 and returns back to the right guide sheave 13. The outer hoisting rope 7*b* further passes over outer equalizer sheaves 18 and 18, the right guide sheave 14 and a sheave 8 mounted on the hoisting plate 6, and returns back to the hoisting drum 11 through the right guide sheave 14.

Figure 2:
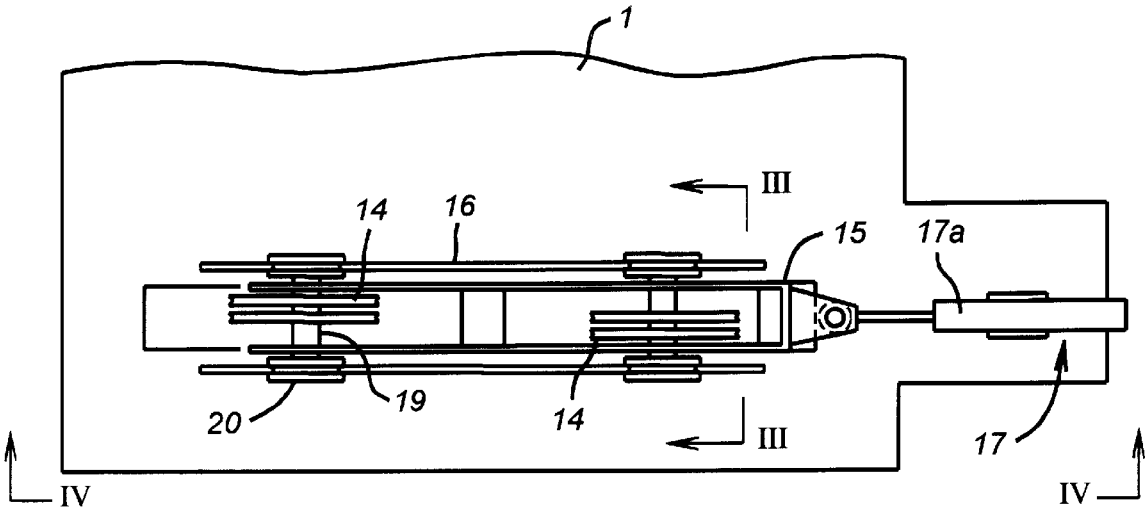
FIG. 2 is a plan view illustrating the movable frame and the drive means of FIG. 1.
Figure 3:
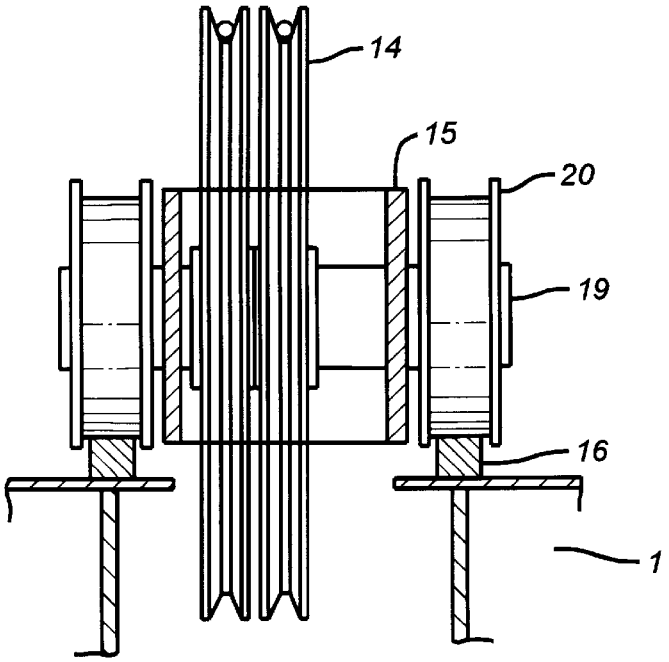
FIG. 3 is an enlarged sectional view taken substantially along line III—III of FIG. 2.

FIG. 2 is a plan view illustrating the guide sheaves 14, 14 and the movable frame 15, and FIG. 3 is an enlarged sectional view taken substantially along line III—III of FIG. 2. The guide sheaves 14 and 14 are freely rotatably supported on one end of a first shaft 19 and on the other end of a second shaft 19 of the movable frame 15 so that the hoisting ropes 7*a* and 7*b* on the guide sheaves 14 and 14 do not interfere with each other.

The movable frame 15 is freely movable on the rail 16 by wheels 20 rotatably supported on the both ends of the shaft 19 supporting the guide sheave 14. In this embodiment, the drive means 17 comprises a hydraulic cylinder 17*a*, and the rear end of the movable frame 15 is connected to the drive end of the hydraulic cylinder 17*a* mounted on the transverse trolley 1.

Figure 4:
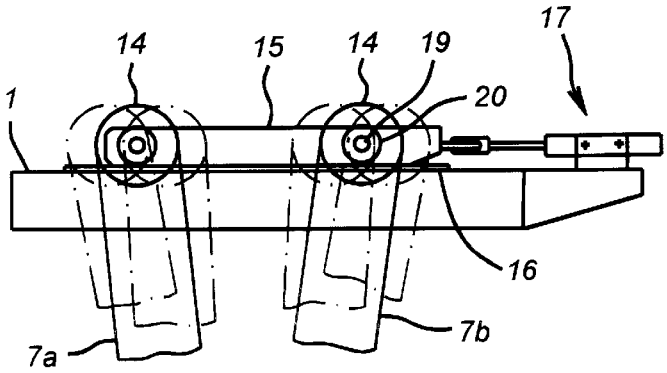
FIG. 4 is a side view taken substantially along line IV—IV of FIG. 2.

As shown in FIG. 4, the movable frame 15 is movable forward and backward, for example, between 0 and 250 mm and between 0 and 250 mm by the drive means 17.

Figure 5:
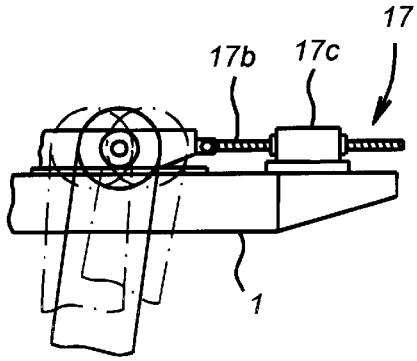
FIG. 5 is a side view showing another embodiment of the drive means of FIG. 4.
Figure 6:
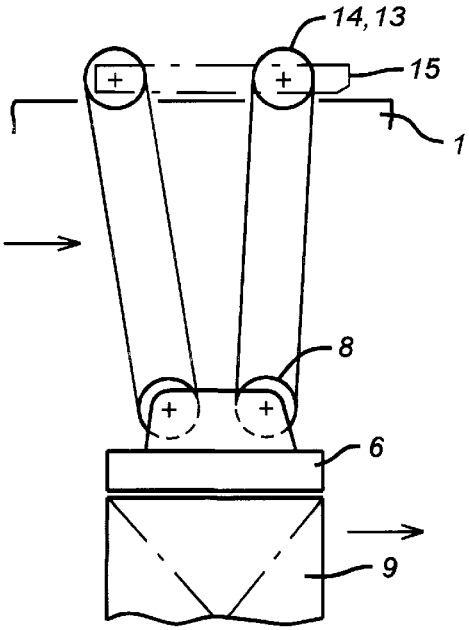
FIGS. 6 and 7 are side elevational views for explaining how oscillations of hoisted cargo may be stopped according to the present invention.

It is noted that the drive means 17 may comprise other drive mechanisms or other drive sources other than a hydraulic source. For example, the drive means 17 may comprise a ball screw 17*b* connected to the movable frame 15 and a screw feed motor 17*c*, as shown in FIG. 5.

The operation of the apparatus for stopping an oscillation of hoisted cargo according to the present invention will be described. If it is assumed that the transversely movable trolley 1 in the position of FIG. 1 is transversely moved from left to right, the hoisting plate 6 is swung forward because of a force of inertia, particularly when the transverse trolley 1 is decelerated. This transverse swing is detected by a crane operator monitoring a swing visual-detection mark 10 marked on the hoisting plate 6. If the transverse swing is detected, the drive means 17 and 17 mounted on the both side ends of the transverse trolley 1 are driven concurrently with an occurrence of the transverse swing, and the movable frames 15 are moved in the direction of the transverse swing, as shown in FIG. 7. The movable frames 15 are further moved in the opposite direction concurrently with a reaction of the hoisting plate 6, so that the transverse swing can be attenuated and stopped in a short period of time.

When, as indicated by an arrow 21 in FIG. 1, a skew (swivel swing) of the hoisting plate 6 occurs in a horizontal plane in a clockwise direction, the skew is likewise detected by movement of the mark 10 and the drive means 17 and 17 are driven so that this side frame 15 is moved left and the opposite side frame 15 is moved right. That is, the two frames 15 and 15 are moved so as to follow the clockwise movement of the hoisting plate 6. With respect to a reaction of the skew, the frames 15 are moved in the opposite directions. As a consequence, the skew can also be attenuated and stopped in a short period of time.

When the transverse swing and the skew occur at the same time, a quantity of the transverse swing and a quantity of the skew are added at the left and right sides of the transverse trolley 1, and the two frames 15 and 15 are respectively driven and moved in requisite directions by the added quantity. Since a control quantity required for a control of the transverse swing and the skew is supplied synchronously, the transverse swing and the skew different from each other can be attenuated and stopped concurrently and reliably.

The aforementioned manipulation and control can also be automatically performed by providing a camera on the transverse trolley 1. The transverse swing and skew of the hoisting plate 6 are detected with the camera, and a control quantity corresponding to the transverse swing and skew of the hoisting plate 6 is calculated in a control unit by picture processing. By automatically moving the frames 15 and 15 in accordance with the calculated control quantity, the transverse swing and skew of the hoisting plate 6 can be automatically attenuated and stopped.

INDUSTRIAL APPLICABILITY

In accordance with the present invention, the number of the movable frames is reduced by half and the manipulation of the movable frames at the time of stopping the transverse swing and the skew is simplified and the distance of movement of the movable frames is small. In addition, the transverse swing and the skew are both stopped by only a control of movement of the movable frames. Accordingly, the apparatus for stopping oscillations of hoisted cargo according to the present invention is simple in structure and easy in control, and is capable of concurrently stopping the transverse swing and the skew with reliability. Therefore, the present invention has very useful industrial applications.

We claim:

1. An apparatus for stopping an oscillation of a hoisted cargo, comprising:

a trolley moveable along a main girder of a crane;

a pair of moveable frames which are disposed on the trolley in parallel with the direction of movement of the trolley and which are only moveable with respect to the trolley in the plane of the trolley, in parallel with the direction of movement of the trolley;

two sets of guide sheaves for hoisting ropes fixedly arranged on each of said pair of moveable frames with a certain fixed distance between the sets; and a pair of drive means, which are actuated independently of each other and which are disposed on said trolley for moving said pair of moveable frames independently with respect to said trolley in the plane of the trolley, in parallel with the direction of movement of the trolley.

2. An apparatus as set forth in claim 1, wherein each of said pair of drive means comprises a hydraulic cylinder.

3. An apparatus as set forth in claim 1, wherein a camera is disposed on said transversely movable trolley, said camera detects a motion of said hoisted cargo, an image from said camera is image processed for calculating a control quantity corresponding to the detected motion, and said movable frames are automatically controlled for their movement based on the control quantity.

4. An apparatus for stopping an oscillation of a hoisted cargo, comprising:

a trolley moveable along a main girder of a crane;

a pair of moveable frames which are disposed on the trolley and which are only moveable with respect to the trolley in the plane of the trolley in parallel with the direction of movement of the trolley;

two sets of guide sheaves for hoisting ropes fixedly arranged on each of said pair of moveable frames with a certain fixed distance between the sets; and a pair of drive means disposed on said trolley for moving said pair of moveable frames independently with respect to said trolley in the plane of the trolley, in parallel with the direction of movement of the trolley, wherein a transverse swing of said hoisted cargo is stopped by simultaneously moving said moveable frames in a same direction concurrently with said transverse swaying of said hoisted cargo, and wherein a skew motion of said hoisted cargo is stopped by simultaneously moving said moveable frames in opposite directions concurrently with said skew motion of said hoisted cargo.

* * * * *